US009903066B2

(12) United States Patent
Lim et al.

(10) Patent No.: US 9,903,066 B2
(45) Date of Patent: Feb. 27, 2018

(54) WASHING MACHINE

(71) Applicant: SAMSUNG ELECTRONICS CO., LTD., Suwon-si, Gyeonggi-do (KR)

(72) Inventors: Kyung Up Lim, Seoul (KR); Hong Seok Ko, Yongin-si (KR); Sang Wook Kim, Suwon-si (KR); Yongjie Jin, Seoul (KR); Jae Sin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 251 days.

(21) Appl. No.: 14/495,286

(22) Filed: Sep. 24, 2014

(65) Prior Publication Data

US 2015/0121969 A1 May 7, 2015

(30) Foreign Application Priority Data

Nov. 7, 2013 (KR) ..... 10-2013-0134967

(51) Int. Cl.
*D06F 39/08* (2006.01)
*D06F 23/04* (2006.01)
*D06F 37/26* (2006.01)

(52) U.S. Cl.
CPC ..... *D06F 39/088* (2013.01); *D06F 23/04* (2013.01); *D06F 37/267* (2013.01); *D06F 39/08* (2013.01)

(58) Field of Classification Search
CPC ..... D06F 23/04; D06F 39/08; D06F 39/088
See application file for complete search history.

(56) References Cited

U.S. PATENT DOCUMENTS 5,768,730 A * 6/1998 Matsumoto ..... D06F 25/00 210/144
5,937,677 A 8/1999 Lee
7,677,062 B2 * 3/2010 Zaccone ..... D06F 25/00 68/207
2009/0249838 A1 * 10/2009 Kim ..... D06F 39/083 68/58

(Continued)

FOREIGN PATENT DOCUMENTS

CN 201151833 11/2008
CN 201598475 10/2010

(Continued)

OTHER PUBLICATIONS

Chinese Office Action dated Oct. 10, 2017 in Chinese Patent Application No. 201410592440.0.

*Primary Examiner* — Joseph L Perrin
(74) *Attorney, Agent, or Firm* — Staas & Halsey LLP

(57) ABSTRACT

A washing machine includes a cabinet; a tub which is disposed in the cabinet and in which washing water is stored; a rotating tub that is disposed in the tub and accommodates laundry; a spray unit configured to spray washing water into the rotating tub; and a fixing unit to which at least a portion of the spray unit is coupled and which includes a mounting structure provided at at least a portion of a circumferential direction of the fixing unit so as to fix the spray unit. The mounting structure in which a spray unit can be fixed by a fixing unit provides that movement of the spray unit can be prevented when a washing machine operates and the spray unit can be assembled in a desired position of the washing machine.

27 Claims, 9 Drawing Sheets

(56) References Cited

U.S. PATENT DOCUMENTS

| | | | | |
|---|---|---|---|---|
| 2009/0249840 | A1* | 10/2009 | Jo | D06F 39/008 68/5 C |
| 2010/0236001 | A1* | 9/2010 | Lee | D06F 33/02 8/159 |
| 2010/0294004 | A1* | 11/2010 | Hu | D06F 29/00 68/13 R |
| 2011/0088172 | A1* | 4/2011 | Im | D06F 33/02 8/137 |
| 2013/0145562 | A1* | 6/2013 | Lee | D06F 37/266 8/137 |

FOREIGN PATENT DOCUMENTS

| | | |
|---|---|---|
| CN | 102102285 | 6/2011 |
| CN | 102535113 | 7/2012 |
| CN | 202766854 | 3/2013 |

* cited by examiner

WASHING MACHINE

CROSS-REFERENCE TO RELATED APPLICATIONS

This application claims the benefit of Korean Patent Application No. 10-2013-0134967, filed on Nov. 7, 2013 in the Korean Intellectual Property Office, the disclosure of which is incorporated herein by reference.

BACKGROUND

1. Field

Embodiments of the present disclosure relate to a washing machine, and more particularly, to a washing machine having an improved structure of a fixing unit for fixing a spray unit spraying washing water.

2. Description of the Related Art

A washing machine is a machine that washes laundry using power, generally includes a tub in which water is stored, a rotating tub that is rotatably disposed in the tub, a pulsator that is rotatably installed on a bottom of the rotating tub, a driving unit for rotating the rotating tub and the pulsator, and a clutch that causes a rotational force to be selectively transferred to the rotating tub according to whether washing or dehydration is performed.

When the rotating tub and the pulsator are rotated in a state in which the laundry and detergent water are put into the rotating tub, the pulsator agitates the laundry put into the rotating tub together with washing water so that dirt stained on the laundry can be removed.

In general, washing water is sprayed into the rotating tub via a spray unit. In order to spray washing water at a plurality of points, nozzles through which washing water is sprayed, are additionally attached to the spray unit. In this case, an additional injection structure needs to be formed.

SUMMARY

Therefore, it is an aspect of the present disclosure to provide a washing machine having an improved structure of a fixing unit including a mounting structure that is capable of fixing a spray unit.

Additional aspects of the disclosure will be set forth in part in the description which follows and, in part, will be apparent from the description, or may be learned by practice of the disclosure.

In accordance with one aspect of the present disclosure, there is provided a washing machine including: a cabinet; a tub which is disposed in the cabinet and in which washing water is stored; a rotating tub that is disposed in the tub and accommodates laundry; a spray unit configured to spray washing water into the rotating tub; and a fixing unit to which at least a portion of the spray unit is coupled and which includes a mounting structure provided at at least a portion of a circumferential direction of the fixing unit so as to fix the spray unit.

The mounting structure may fix one among an upper portion, a lower portion, and sides of at least a portion of the spray unit.

The mounting structure may include a mounting groove provided to be recessed into an inner side from an outer side of the fixing unit so that the spray unit can be inserted into the mounting structure.

The mounting structure may further include at least one side rib that extends to a top surface of the fixing unit so as to prevent the spray unit from being deviated from the outer side of the fixing unit.

The mounting structure may further include at least one upper rib that is disposed to protrude from the outer side of the fixing unit and that fixes a top surface of the spray unit so as to prevent vertical movement of the spray unit.

The upper rib and the side rib may be disposed to cross each other.

The mounting structure may further include at least one lower rib that is disposed to protrude in an upward direction from a bottom surface of the mounting groove and that fixes a bottom surface of the spray unit so as to prevent vertical movement of the spray unit.

The spray unit may include a first nozzle through which washing water is sprayed onto one surface of the fixing unit and a second nozzle through which washing water is sprayed onto the other surface of the fixing unit.

At least a portion of the mounting structure may be provided to be inclined in an upward direction from the first nozzle to the second nozzle.

A spray portion may be provided at at least a portion of the fixing unit coupled to at least one of the first nozzle and the second nozzle so as to communicate with the rotating tub.

At least one surface of the spray portion may be provided to protrude so as to prevent washing water from spattering on the outer side of the fixing unit.

A communicating portion may be provided at the spray portion so as to face the rotating tub, and the communicating portion may be provided to be widened as it gets closer to a lower side of the communicating portion so that a region in which washing water is to be sprayed, can be widened.

In accordance with another aspect of the present disclosure, there is provided a washing machine including: a cabinet; a tub which is disposed in the cabinet and in which washing water is stored; a rotating tub that is disposed in the tub and accommodates laundry; a spray unit configured to spray washing water into the rotating tub at a plurality of points; and a fixing unit including at least one rib so as to fix the spray unit.

The at least one rib may include a side rib provided to cover sides of the spray unit and an upper rib provided to cover a top surface of the spray unit.

A first region in which the side rib is placed, and a second region in which the upper rib is placed, may be different from each other.

The rib may further include a lower rib that supports a bottom surface of the spray unit, and the lower rib may be placed at at least one of both ends of the side rib.

The fixing unit may include a mounting groove provided to be recessed into an inner side from an outer side of the fixing unit so that the spray unit can be inserted into the mounting groove.

The spray unit may include a first nozzle through which washing water is sprayed onto one surface of the fixing unit, and a second nozzle through which washing water is sprayed onto the other surface of the fixing unit.

The rib that protrudes from a bottom surface of the mounting groove may be provided so that a length of the rib at which the rib protrudes from the first nozzle to the second nozzle, can be increased.

A connection hose that connects the first nozzle and the second nozzle may be inserted into the mounting groove.

In accordance with still another aspect of the present disclosure, there is provided a washing machine including: a cabinet; a tub which is disposed in the cabinet and in which washing water is stored; a rotating tub that is disposed in the tub and accommodates laundry; a spray unit including at least one nozzle through which washing water is sprayed into the rotating tub and a hose that is a flow path transferring washing water to the nozzle; and a fixing unit at which a communicating hole through which the at least one nozzle passes, is provided and to which at least a portion of the hose is coupled in a circumferential direction of the fixing unit.

The fixing unit may include a mounting groove provided to be recessed into an inner side from an outer side of the fixing unit, and at least a portion of the hose may be inserted into the mounting groove.

The fixing unit may include a side rib, of which an outer wall protrudes upward, and an upper rib placed at an upper portion of the mounting groove so as to fix the hose, and the side rib and the upper rib may be disposed to cross each other.

The spray unit may include a first nozzle coupled to one point of the fixing unit and a second nozzle coupled to the other point of the fixing unit.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
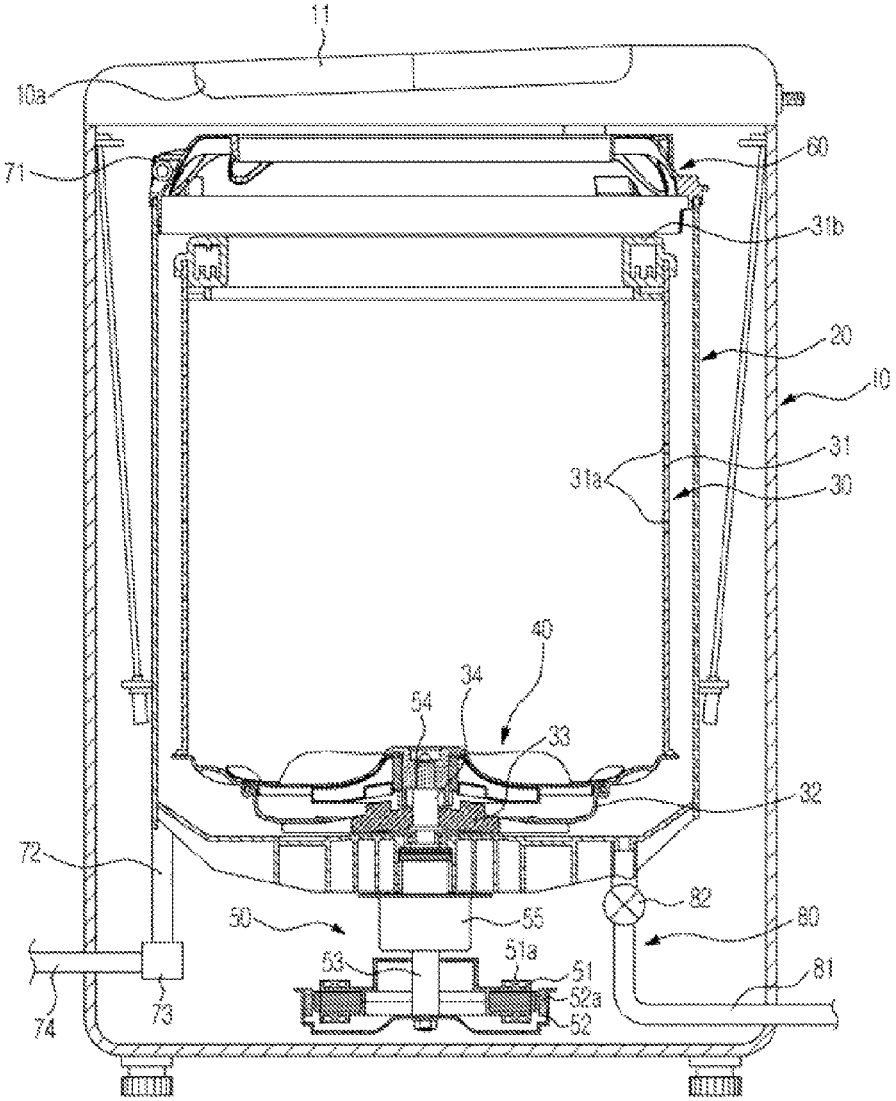
FIG. 1 is a cross-sectional view of a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view of a washing machine according to an embodiment of the present disclosure.

As illustrated in FIG. 1, the washing machine according to the current embodiment of the present disclosure includes a cabinet 10 that constitutes an exterior, a tub 20 which is disposed in the cabinet 10 and in which water is stored, a rotating tub 30 that is rotatably disposed in the tub 20, a pulsator 40 that is installed in the rotating tub 30 and generates a water current, and a driving unit 50 that rotates the pulsator 40.

The cabinet 10 includes a laundry port 10*a* which is provided on a top surface of the cabinet 10 and through which laundry may be put into the rotating tub 30. A door 11 is installed at an upper portion of the cabinet 10, is installed to be pivoted with respect to the cabinet 10, and opens/closes the laundry port 10*a*.

The tub 20 is suspended and installed in the cabinet 10 and accommodates water to be used in washing. A spray unit 70 is disposed at an upper side of the tub 20 so as to supply water into the tub 20, and a drainage unit 80 is disposed at a lower side of the tub 20 so as to discharge water used in washing to the outside. The spray unit 70 may be coupled to a fixing unit 60 coupled to the upper side of the tub 20.

The spray unit 70 includes a water supply pipe 74 connected to an external water supply source (not shown) and a pump 73 that is connected to the water supply pipe 74 so as to pump water into the rotating tub 30. Washing water is transferred to a plurality of nozzles (see 77 and 78 of FIG. 3) from the pump 73 through an integrated hose 72.

The drainage unit 80 includes a drainage pipe 81 that is connected to a lower portion of the tub 20 and guides water in the tub 20 to be discharged to the outside, and a drainage valve 82 that is disposed on the drainage pipe 81 and opens/closes the drainage pipe 81.

The rotating tub 30 includes a body portion 31 having a cylindrical shape in which an upper portion of the rotating tub 30 is opened, and a bottom surface portion 32 that is fixed to a bottom end of the body portion 31 and constitutes a bottom surface of the rotating tub 30. Communicating holes 31 a through which water in the tub 20 may be introduced into the rotating tub 30 and simultaneously water in the rotating tub 30 may be discharged toward the tub 20, are provided in the body portion 31. Also, a balancer 31*b* may be coupled to the upper portion of the rotating tub 30 so that an unbalanced load of the rotating tub 30 can be offset and the rotating tub 30 can be stably rotated.

The rotating tub 30 is rotated by power transmitted from the driving unit 50 via the pulsator 40 from the driving unit 50 via the pulsator 40. To this end, the rotating tub 30 includes a driving flange 33 that is installed at the bottom surface portion 32 that constitutes a lower portion of the rotating tub 30 and receives power from the pulsator 40.

A hollow dehydration shaft 34 that constitutes a center of rotation of the rotating tub 30, is installed at the driving flange 33, and a washing shaft 54 is rotatably installed in the dehydration shaft 34.

The pulsator 40 is rotated clockwise or counterclockwise within the rotating tub 30 and generates a water current. The laundry in the rotating tub 30 is agitated by the water current generated by the pulsator 40 and is washed by friction.

The driving unit 50 is disposed at the lower portion of the tub 20 and generates a rotational force by power applied to the driving unit 50. The driving unit 50 includes a stator 51 having a coil 51 a, a rotator 52 that includes a magnet 52*a* interacting with the coil 51 a and rotates by interacting with the stator 51, a driving shaft 53 having a bottom end connected to a center of the rotator 52, the washing shaft 54 that transmits a rotational force to the pulsator 40, and a deceleration unit 55 that is disposed between the driving shaft 53 and the washing shaft 54 and includes an epicyclic gear for deceleration.

Figure 2:
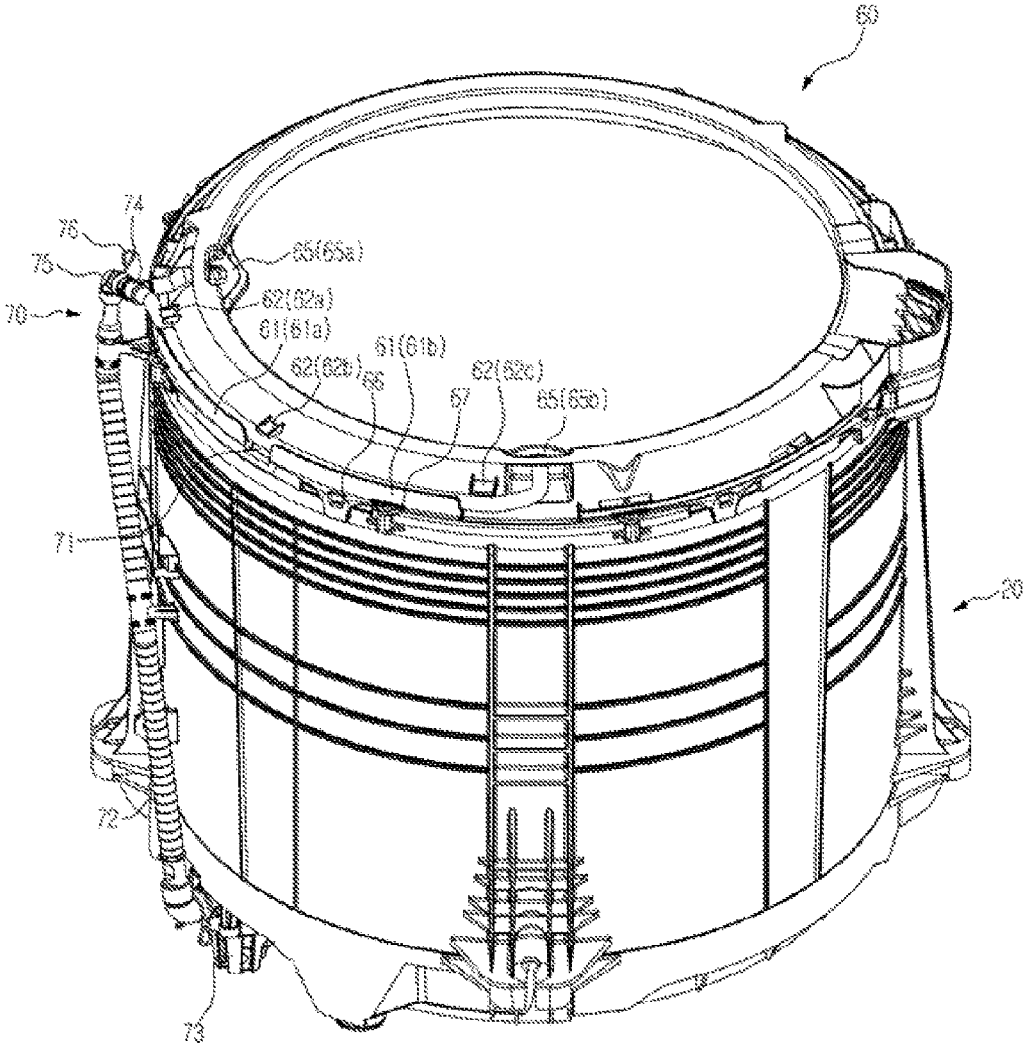
FIG. 2 illustrates a state in which a tub, a fixing unit, and a spray unit of the washing machine illustrated in FIG. 1 are combined with each other.
Figure 3:
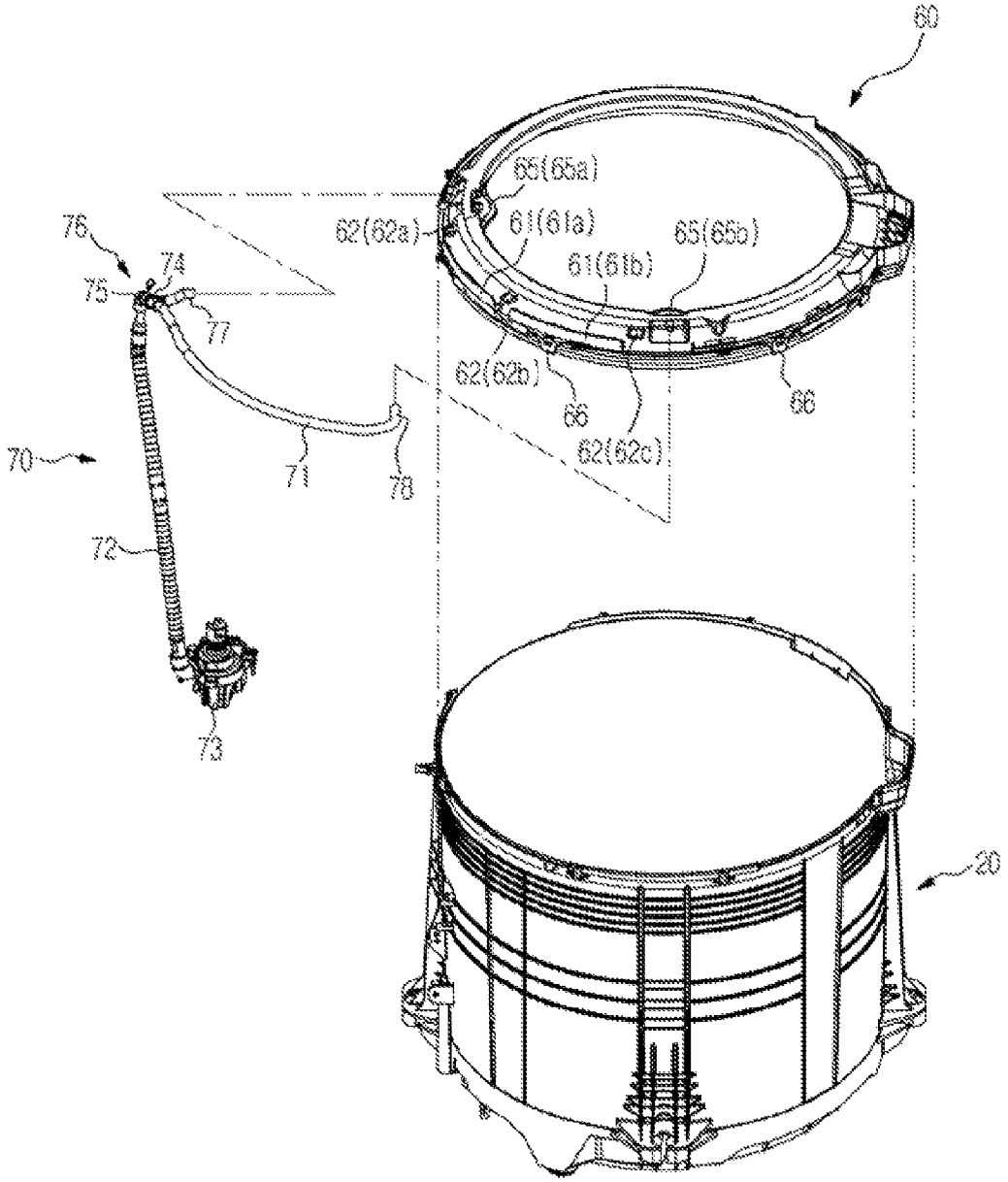
FIG. 3 illustrates a state in which the tub, the fixing unit, and the spray unit of the washing machine of FIG. 1 are disassembled.

FIG. 2 illustrates a state in which a tub, a fixing unit, and a spray unit of the washing machine illustrated in FIG. 1 are combined with each other, and FIG. 3 illustrates a state in which the tub, the fixing unit, and the spray unit of the washing machine of FIG. 1 are disassembled.

As illustrated in FIGS. 2 and 3, the spray unit 70 is configured to spray washing water into the rotating tub 30 and is combined with the fixing unit 60. A mounting structure for fixing the spray unit 70 may be provided at the fixing unit 60. According to an embodiment of the present disclosure, the mounting structure may be provided along a circumferential direction of the fixing unit 60.

The spray unit 70 may include the pump 73 for pumping washing water and the integrated hose 72 that connects the pump 73 and the nozzles 77 and 78. The spray unit 70 may include the plurality of nozzles 77 and 78 and may spray washing water into the rotating tub 30 at a plurality of points. According to an embodiment of the present disclosure, the spray unit 70 includes a first nozzle 77 and a second nozzle 78 and sprays washing water into the rotating tub 30 at two points. A connector 74 may be placed between the integrated hose 72 and the plurality of nozzles 77 and 78. The connector 74 causes a flow path of washing water to be split into the plurality of nozzles 77 and 78 from the integrated hose 72. The first nozzle 77 may be provided at one point close to the connector 74, and the second nozzle 78 may be disposed farther than the first nozzle 77. A connection hose 71 may be placed between the second nozzle 78 and the connector 74.

The mounting structure may fix one among an upper portion, a lower portion, and sides of at least a portion of the spray unit 70. The mounting structure may include a mounting groove 64 (see FIG. 5) provided to be recessed into an inner side from an outer side of the fixing unit 60 so that the at least a portion of the spray unit 70 can be inserted into the mounting groove 64. The connection hose 71 that connects the connector 74 and the second nozzle 78 may be inserted into the mounting groove 64.

The mounting structure may include at least one or more ribs 61, 62, and 63 so as to prevent movement of the spray unit 70. This will be described below.

A spray portion 65 may be provided at the fixing unit 60 to communicate with the rotating tub 30 so that washing water can be sprayed into the rotating tub 30 from the plurality of nozzles 77 and 78. The spray portion 65 may be provided at the spray unit 70 to protrude from the fixing unit 60 in an inward direction of the rotating tub 30. According to an embodiment of the present disclosure, since the first nozzle 77 and the second nozzle 78 are provided, two spray portions 65 may also be provided.

The fixing unit 60 and the tub 20 may be coupled to each other via coupling portions 66 and 67. According to an embodiment of the present disclosure, the coupling portions 66 and 67 may be provided at the fixing unit 60. The coupling portions 66 and 67 may include a first coupling portion 66 provided to protrude from the fixing unit 60 in a downward direction, and a second coupling portion 67 provided so that an additional fastening member (not shown) can be inserted into the second coupling portion 67. The first coupling portion 66 may be inserted into the tub 20 in a hook coupling manner, and a fastening member (not shown) may be fastened to the second coupling portion 67 so that the tub 20 and the fixing unit 60 can be coupled to each other.

Figure 4:
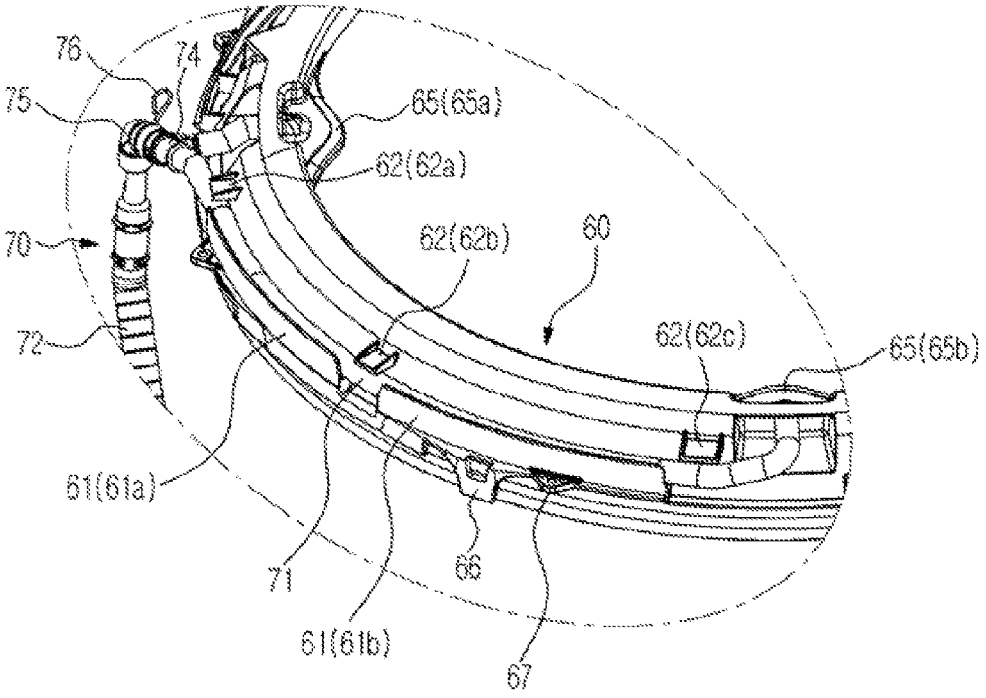
FIG. 4 is an enlarged view illustrating a state in which the fixing unit and the spray unit of the washing machine of FIG. 1 are combined with each other, according to an embodiment of the present disclosure.
Figure 5:
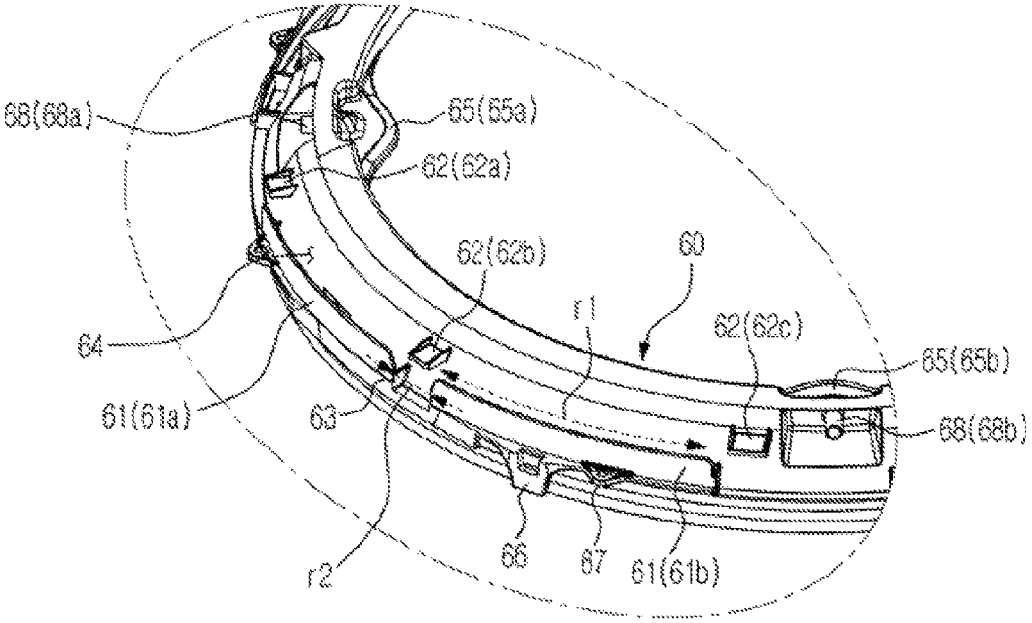
FIG. 5 is an enlarged view illustrating a state in which the spray unit is disassembled from the fixing unit of the washing machine of FIG. 1, according to an embodiment of the present disclosure.
Figure 6:
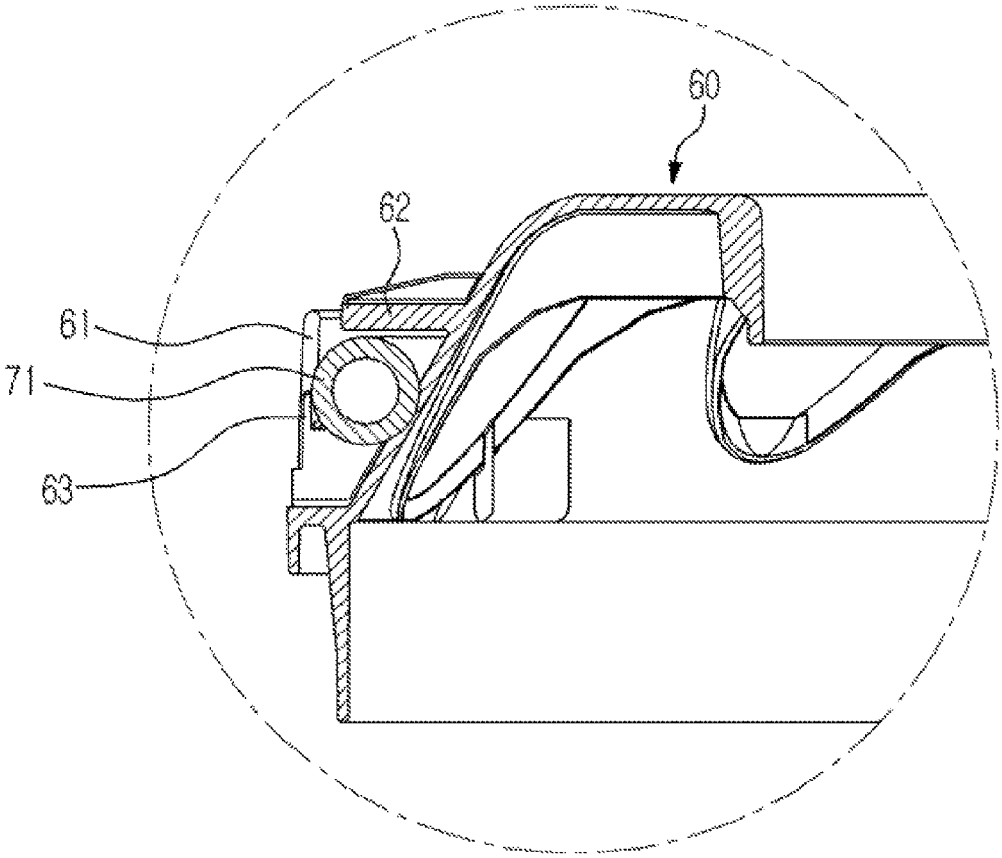
FIG. 6 is a cross-sectional view illustrating a state in which the spray unit is combined with the fixing unit of the washing machine of FIG. 1.

FIG. 4 is an enlarged view illustrating a state in which the fixing unit and the spray unit of the washing machine of FIG. 1 are combined with each other, according to an embodiment of the present disclosure, and FIG. 5 is an enlarged view illustrating a state in which the spray unit is disassembled from the fixing unit of the washing machine of FIG. 1, according to an embodiment of the present disclosure, and FIG. 6 is a cross-sectional view illustrating a state in which the spray unit is combined with the fixing unit of the washing machine of FIG. 1.

As illustrated in FIGS. 4 through 6, the fixing unit 60 includes the mounting structure for fixing the spray unit 70. Hereinafter, the mounting structure will be described in detail.

The mounting groove 64 into which the connection hose 71 is inserted, may be provided at the fixing unit 60. According to an embodiment of the present disclosure, the fixing unit 60 may include at least one side rib 61. The at least one side rib 61 extends to an upper portion of the fixing unit 60 and prevents the connection hose 71 of the spray unit 70 from being deviated from the outer side of the fixing unit 60.

Also, the mounting structure may further include an upper rib 62 that fixes a top surface of the connection hose 71 of the spray unit 70 so as to prevent vertical movement of the spray unit 70. The upper rib 62 may be placed at an upper portion of the connection hose 71 and may protrude to cover a portion of a top surface of the mounting groove 64.

Also, the mounting structure may further include a lower rib 63 that supports a bottom surface of the connection hose 71 of the spray unit 70 so as to support a bottom surface of the spray unit 70.

According to an embodiment of the present disclosure, the side rib 61 and the upper rib 62 may be disposed to cross each other. That is, when a region in which the side rib 61 is placed is defined as a first region r1 and a region in which the upper rib 62 is placed is defined as a second region r2, the first region r1 and the second region r2 may be different from each other. The upper rib 62 may be disposed at a portion where the side rib 61 is not placed. According to an embodiment of the present disclosure, three upper ribs 62*a*, 62*b*, and 62*c* and two side ribs 61*a* and 61*b* may be provided. According to the drawings, the lower rib 63 is provided at both ends of the side ribs 61*a* and 61*b*. However, embodiments of the present disclosure are not limited thereto.

The plurality of nozzles 77 and 78 may be coupled to the spray portion 65 of the fixing unit 60. The spray portion 65 may be provided to protrude in an inward direction of the rotating tub 30. The nozzles 77 and 78 are coupled to a communicating pipe 68 provided to protrude from the spray portion 65. This will be described later.

Figure 7:
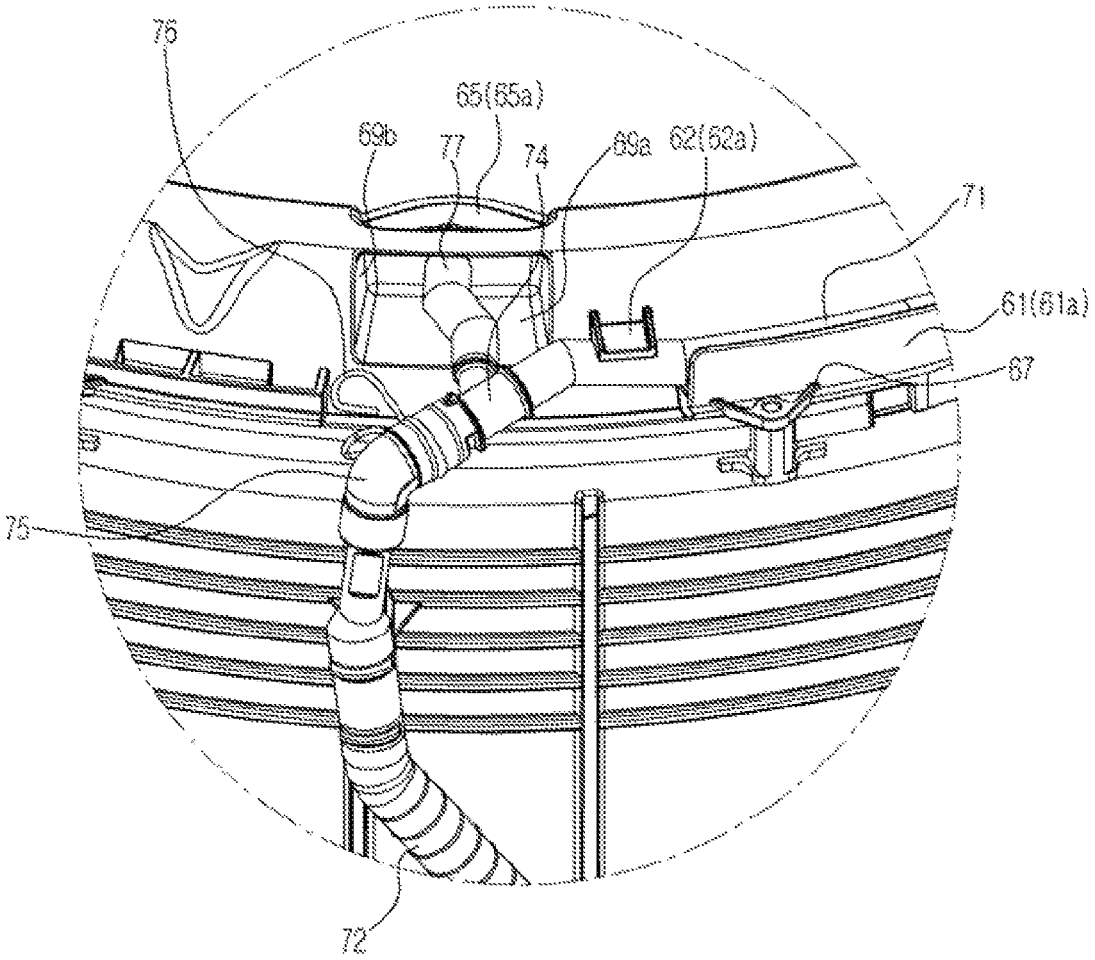
FIG. 7 is an enlarged view of nozzles of the spray unit of the washing machine of FIG. 1.
Figure 8:
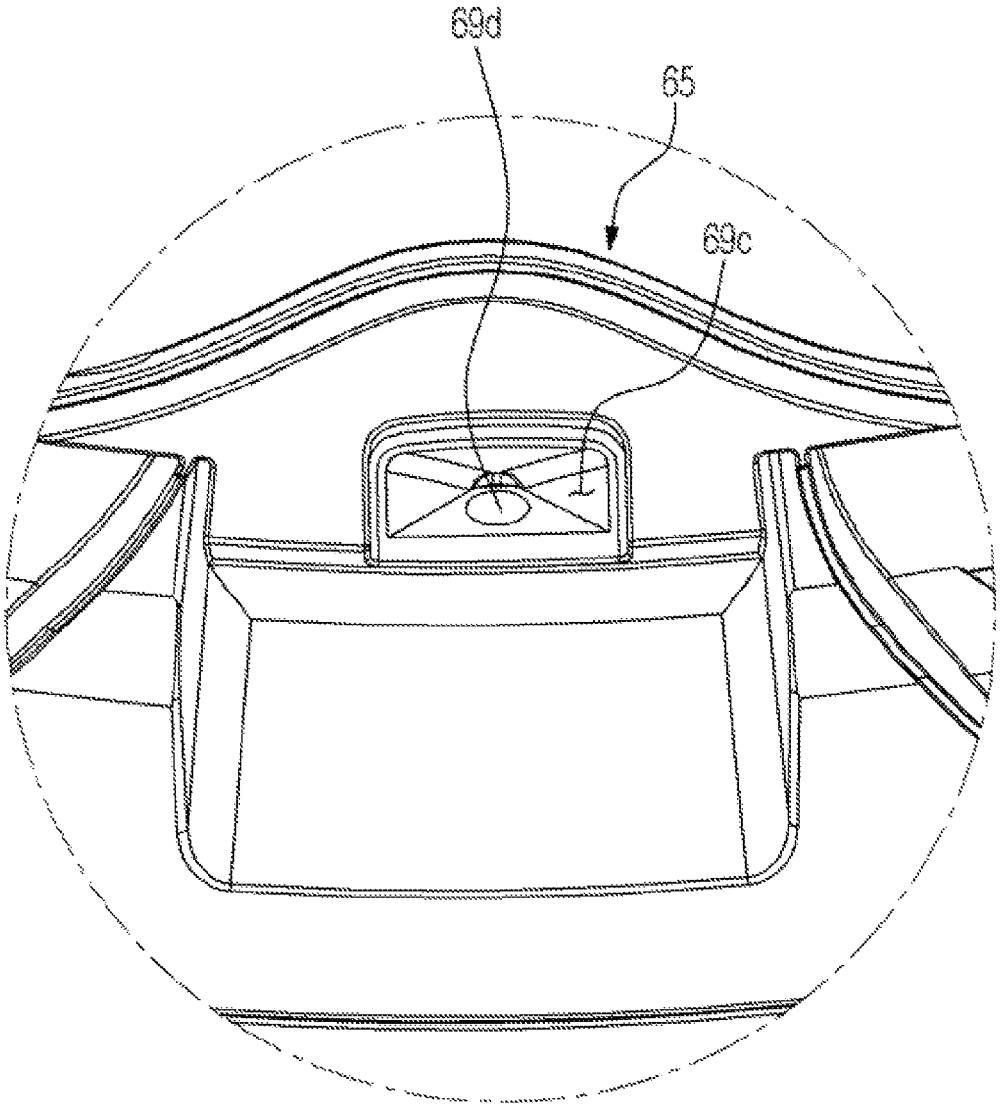
FIG. 8 is an enlarged view of another side of the fixing unit of the washing machine of FIG. 1.

FIG. 7 is an enlarged view of nozzles of the spray unit of the washing machine of FIG. 1, and FIG. 8 is an enlarged view of another side of the fixing unit of the washing machine of FIG. 1.

As illustrated in FIGS. 7 and 8, the nozzles 77 and 78 of the spray unit 70 may be coupled to the spray portion 65. Each of the other sides of the nozzles 77 and 78 that are respectively coupled to the connector 74 is coupled to the spray portion 65. The other side of the connector 74 may be coupled to a guide pipe 75 for guiding coupling of the connector 74 and the connection hose 71. The connector 74 may be inserted into the guide pipe 75, and a holder 76 for fixing the guide pipe 75 and the connector 74 may be coupled onto a surface of the guide pipe 75.

A bottom surface 69*a* of the spray portion 65 may be provided to protrude in an upward direction compared to the mounting structure so as to prevent washing water from spattering on the outer side of the fixing unit 60. Also, sidewalls 69*b* of the spray portion 65 may be provided to protrude outward compared to the communicating pipe 68. This is to prevent washing water from spattering on the outer side of the fixing unit 60.

Also, washing water may be widely sprayed into the rotating tub 30 due to a guide portion 69*c* that is provided to be widened as getting closer to its lower side around a communicating hole 69*d* that communicates with the communicating pipe 68 and faces an inner side of the rotating tub 30.

Figure 9:
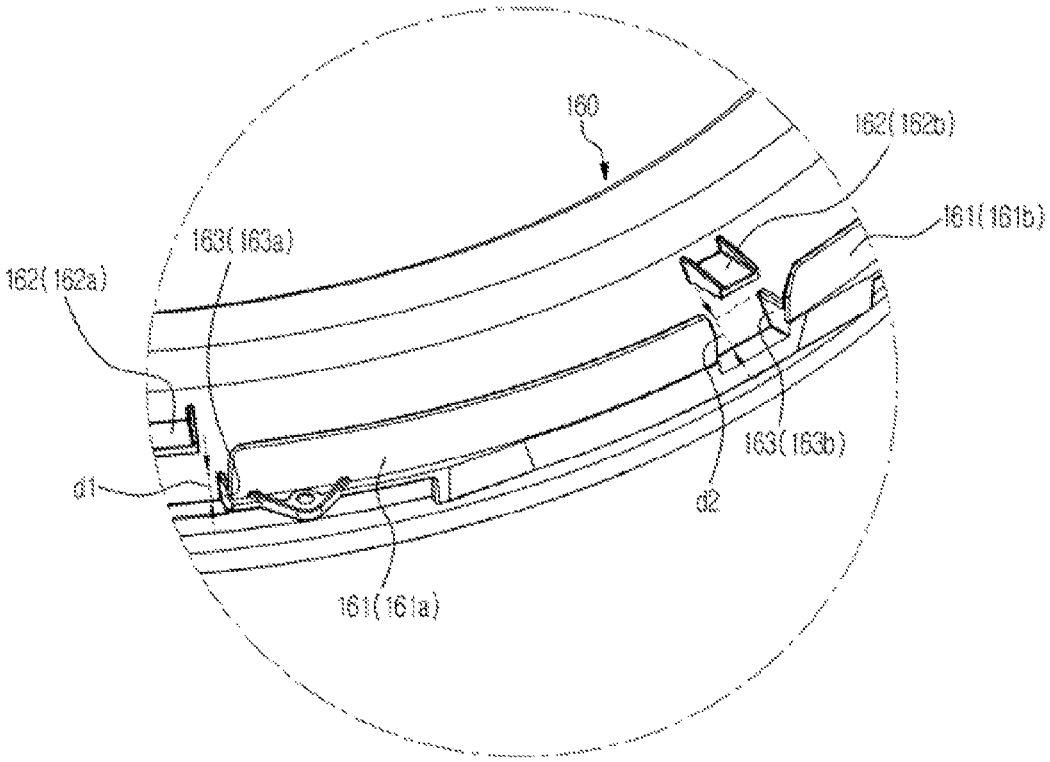
FIG. 9 is an enlarged view illustrating a state in which the spray unit is disassembled from the fixing unit of the washing machine of FIG. 1, according to another embodiment of the present disclosure.

FIG. 9 is an enlarged view illustrating a state in which the spray unit is disassembled from the fixing unit of the washing machine of FIG. 1, according to another embodiment of the present disclosure.

As illustrated in FIG. 9, according to another embodiment of the present disclosure, at least a portion of the mounting structure may be provided to be inclined in an upward direction from the first nozzle 77 to the second nozzle 78. According to the other embodiment of the present disclosure, a length of a lower rib 163 at which it protrudes upward, may be provided to be increased as it gets closer to the second nozzle 78. That is, when a length at which a lower rib 163*a* close to the first nozzle 77 protrudes upward, is defined as dl and a length at which a lower rib 163*b* close to the second nozzle 78 protrudes upward, is defined as d2, a relationship of d1<d2 may be established. This is to mount the connection hose 71 so that washing water can be smoothly transferred to the second nozzle 78 placed far from the integrated hose 72. Since the lower rib 163 further protrudes as it gets closer to the second nozzle 78, the connection hose 71 may be pressurized so that washing water can be smoothly transferred to the second nozzle 78.

In addition, the mounting structure may include an upper rib 162 and a side rib 161, as described above.

As described above, according to the embodiments of the present disclosure, a mounting structure in which a spray unit can be fixed by a fixing unit, is improved so that movement of the spray unit can be prevented when a washing machine operates and the spray unit can be assembled in a desired position of the washing machine. Accordingly, an additional fastening member for fixing the spray unit need not be prepared so that costs can be reduced and a process time can be reduced.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising: a cabinet;
- a tub disposed in the cabinet and in which water is storable;
- a drum rotatably disposed in the tub to accommodate laundry;
- a pump to supply water;
- a plurality of nozzles disposed around an opening formed at a top of the tub to inject water into the drum;
- a connector defining a plurality of passages through which water flows to the plurality of nozzles;
- a first hose extending between the pump and the connector in an axial direction of the drum;
- a second hose extending between the connector and one of the plurality of nozzles, and including:
  - a first portion extending from the connector in a circumferential direction of the opening, and
  - a second portion extending from the first portion to the one of the plurality of nozzles in a radial direction of the opening; and
  - a fixing unit disposed on the tub to secure the first portion of the second hose to the tub along the circumferential direction of the opening.

2. The washing machine of claim 1, wherein the fixing unit comprises a protrusion to support at least one of an upper portion, a lower portion, and a side portion of the second hose.

3. The washing machine of claim 1, wherein the fixing unit comprises a mounting groove recessed into an inner side of the tub from an outer side of the tub so that the spray unit is insertable into the mounting groove.

4. The washing machine of claim 3, wherein the fixing unit comprises a lower rib protruding from a bottom surface of the mounting groove to prevent movement of the second hose in a radial direction of the drum.

5. The washing machine of claim 1, wherein the fixing unit comprises a side rib that protrudes from a circumferential portion of the tub to prevent movement of the second hose in a radial direction of the drum.

6. The washing machine of claim 5, wherein the fixing unit comprises an upper rib that protrudes from the top surface of the tub towards the side rib to prevent movement of the second hose in the axial direction of the drum.

7. The washing machine of claim 6, wherein the upper rib is provided substantially perpendicular to the side rib.

8. The washing machine of claim 1, wherein the plurality of nozzles comprise a first nozzle disposed closer to the connector and a second nozzle coupled to the second hose.

9. The washing machine of claim 8, wherein at least a portion of the fixing unit is inclined from the first nozzle to the second nozzle.

10. The washing machine of claim 1, wherein at least one of the plurality of nozzles is integrally formed with the tub.

11. A washing machine comprising:
- a cabinet;
- a tub disposed in the cabinet to store water therein and having an opening at a top portion thereof;
- a drum rotatably disposed in the tub to accommodate laundry;
- a pump to supply water;
- a plurality of nozzles to inject water into the drum;
- a connector defining a plurality of passages through which water flows to the plurality of nozzles;
- a first hose extending between the pump and the connector in an axial direction of the drum;
- a second hose extending between the connector and one of the plurality of nozzles, and including
- a first portion extending from the connector in a circumferential direction of the opening, and
- a second portion extending from the first portion to the one of the plurality of nozzles in a radial direction of the opening; and
- a fixing unit separated from the cabinet and disposed on the opening of the tub, and comprising at least one rib provided to secure the first portion of the second hose to the fixing unit along the circumferential direction of the opening.

12. The washing machine of claim 11, wherein the at least one rib comprises a side rib provided to support a side portion of the second hose and an upper rib provided to support an upper portion of the second hose.

13. The washing machine of claim 12, wherein the side rib is disposed away from the upper rib.

14. The washing machine of claim 12, wherein the at least one rib further comprises a lower rib provided to support a lower portion of the second hose.

15. The washing machine of claim 11, wherein the fixing unit comprises a mounting groove recessed into an inner side of the fixing unit from an outer side of the fixing unit so that the second hose is insertable into the mounting groove.

16. The washing machine of claim 15, wherein the plurality of nozzles comprise a first nozzle disposed closer to the connector and a second nozzle coupled to the second hose.

17. A washing machine comprising:

a cabinet;

a tub disposed in the cabinet and in which water is storable;

a rotating tub disposed in the tub to accommodate laundry;

a spray unit comprising at least one nozzle configured to spray the water into the rotating tub and a hose configured to transfer the water to the at least one nozzle, the hose including a first portion extending in a circumferential direction of the tub, and a second portion extending from the first portion to the at least one nozzle in a radial direction of the tub; and a fixing unit separated from the cabinet and disposed on the tub, and to which the first portion of the hose is secured to the fixing unit along a circumferential portion of the fixing unit, and including a communicating hole configured to receive the at least one nozzle.

18. The washing machine of claim 17, wherein the fixing unit comprises a mounting groove recessed into an inner side of the fixing unit from an outer side of the fixing unit and configured to receive the hose.

19. The washing machine of claim 17, wherein the fixing unit comprises a side rib that protrudes from a top surface of the circumferential portion of the fixing unit to prevent movement of the hose in a direction towards the side rib, and an upper rib that protrudes from an upper portion of the mounting groove towards the side rib to prevent movement of the hose in a direction towards the upper rib, and the side rib is provided substantially perpendicular to the upper rib.

20. The washing machine of claim 17, wherein the at least one nozzle comprises a first nozzle coupleable to a first point of the fixing unit and a second nozzle coupleable to a second point of the fixing unit.

21. The washing machine of claim 17, wherein more than half of a total length of the second hose is secured to the tub by the fixing unit along the length of the second hose, thereby reducing a movement of the second hose during an operation of the washing machine.

22. The washing machine of claim 17, wherein the fixing unit is provided along an entire circumference of the opening.

23. A washing machine comprising:

a cabinet;

a tub disposed in the cabinet to store water and having an opening at a top portion thereof;

a drum rotatably disposed, around an axis from a top of the washing machine to a bottom of the washing machine, in the tub to accommodate laundry;

a pump to supply water;

a plurality of nozzles to inject water into the drum;

a connector defining a plurality of passages through which water flows to the plurality of nozzles;

a first hose extending between the pump and the connector in an axial direction of the drum;

a second hose extending between the connector and one of the plurality of nozzles, and including a first portion extending from the connector in a circumferential direction of the opening, and a second portion extending from the first portion to the one of the plurality of nozzles in a radial direction of the opening; and a fixing unit provided at the opening of the tub to secure the first portion of the second hose to the fixing unit along the circumferential direction of the opening, and having a mounting groove recessed into an inner side of the fixing unit from an outer side of the fixing unit in a circumferential portion of the fixing unit to receive the first portion of the second hose.

24. The washing machine of claim 23, wherein the fixing unit further comprises at least one side rib that protrudes from a top surface of the fixing unit to prevent movement of the second hose in a radial direction of the drum.

25. The washing machine of claim 24, wherein the fixing unit further comprises at least one upper rib that protrudes from the top surface of the fixing unit towards the side rib to prevent movement of the second hose in the axial direction of the drum.

26. The washing machine of claim 25, wherein the upper rib is provided substantially perpendicular to the side rib.

27. The washing machine of claim 23, wherein the fixing unit further comprises at least one lower rib that protrudes from a bottom surface of the mounting groove to prevent movement of the second hose in a radial direction of the drum.

* * * * *